US006048194A

United States Patent [19]

Pfefferle et al.

[11] Patent Number: 6,048,194

[45] Date of Patent: Apr. 11, 2000

[54] DRY, LOW $NO_X$ CATALYTIC PILOT

[75] Inventors: William C. Pfefferle, Madison; Shahrokh Etemad, Trumbull; Hasan Ul Karim, Hamden, all of Conn.

[73] Assignee: Precision Combustion, Inc., New Haven, Conn.

[21] Appl. No.: 09/097,174

[22] Filed: Jun. 12, 1998

[51] Int. Cl.[7] ..... F02M 27/02

[52] U.S. Cl. ..... 431/115; 431/7; 431/9; 431/268; 431/328; 60/723

[58] Field of Search ..... 431/7, 9, 170, 431/115, 116, 326, 328, 268; 60/723

[56] References Cited

U.S. PATENT DOCUMENTS

| | | | |
|---|---|---|---|
| 3,804,163 | 4/1974 | Bradley et al. | 431/328 |
| 5,320,089 | 6/1994 | Schaefer et al. | 431/7 |
| 5,394,862 | 3/1995 | Firatli et al. | 431/326 |
| 5,634,784 | 6/1997 | Pfefferle et al. | 431/7 |
| 5,810,577 | 9/1998 | Ledjeff | 431/170 |

FOREIGN PATENT DOCUMENTS

| | | | |
|---|---|---|---|
| 61-140716 | 6/1986 | Japan | 431/268 |

*Primary Examiner*—Ira S. Lazarus
*Assistant Examiner*—Sara Clarke
*Attorney, Agent, or Firm*—McCormick, Paulding & Huber LLP

[57] ABSTRACT

This invention relates to an apparatus and method for increasing the reactivity of a fuel/air mixture prior to homogenous combustion of the mixture. More specifically, this invention is a pilot for a gas turbine combustor which utilizes the heat of combustion within the pilot to increase the reactivity of a portion of the fuel/air mixture utilized by the pilot.

21 Claims, 1 Drawing Sheet

DRY, LOW $NO_X$ CATALYTIC PILOT

BACKGROUND OF THE INVENTION

1. Field of the Invention

This invention relates to an apparatus and method for increasing the reactivity of a fuel/air mixture prior to homogenous combustion of the mixture. More specifically, the present invention is a pilot for a gas turbine combustor which utilizes the heat of combustion within the pilot to increase the reactivity of a portion of the fuel/air mixture utilized by the pilot.

2. Brief Description of the Related Art

Known dry low NOx combustion systems for gas turbines can achieve relatively low emissions levels; however, the use of continuous pilot systems, as distinguished from starter systems, is required to stabilize combustion over a wide range of gas turbine operational conditions and minimize emission levels.

U.S. Pat. No. 5,634,784 represents a state-of-the-art continuous pilot. The patent teaches a catalytic pilot that will make a portion of the fuel/air mixture destined for the pilot's combustion zone more reactive by passing it through a catalytic centerbody. The patent also teaches that by recirculating hot combustion gas products back on to the catalytic centerbody the catalytic centerbody can use the heat of combustion within the pilot to assure that the catalytic component of the centerbody is at a suitably high operating temperature.

The structure of the catalytic centerbody design previously taught has several shortcomings. In particular, no method is provided to limit the temperature of the centerbody, thus the surface temperature could reach the adiabatic flame temperature of the fuel/air mixture, generally above the centerbody's material failure temperature. In addition, the short channel design of the catalyst limits the residence time thus the catalytic reaction of the centerbody fuel/air mixture, which is a critical factor in assuring flame stability within the pilot.

It has now been found that by utilizing the fuel/air mixture passing through the centerbody more fully, a more versatile pilot can be created. The invention accomplishes this by increasing the channel length for the fuel/air mixture within the centerbody. In addition, the fuel/air mixture entering the centerbody is given the function of cooling the centerbody structure, increasing the temperature and overall combustibility of the fuel/air mixture, and allowing the centerbody to be exposed to greater temperatures, even temperatures above the material limit of the centerbody.

SUMMARY OF THE INVENTION

The Dry, Low NOx Catalytic Pilot (hereinafter "pilot") is a continuously operating pilot that stabilizes the combustion within a gas turbine combustor. The basic pilot utilizes two fuel/air flows. One fuel/air flow enters a catalytic centerbody, and by passing through the centerbody obtains a temperature rise by extracting heat from the centerbody and a catalytic pre-reaction. The second fuel/air flow passes through a flow conditioner capable of creating a recirculation zone to provide heat to the centerbody.

The centerbody and flow conditioner are parts of an integrated assembly. In the pilot of the present invention, the combustion zone is maintained downstream of the centerbody. The flow conditioner has the dual functions of contacting the second fuel/air mixture with heated fuel/air exiting the centerbody, and creating a recirculation zone such that hot combustion gases, either through radiation or conduction, impart a temperature rise to the centerbody. The flow conditioner can be any structure capable of accomplishing these functions, such as a swirler, a bluff body, a dump, opposed flow jets, or a combination of any of the above.

The centerbody is mounted on the flow conditioner. During operation, a portion of the centerbody is simultaneously exposed to the heat of the recirculation zone on one surface and the fuel/air mixture entering the centerbody on an opposite surface (or backside). The entering fuel/air mixture sufficiently interacts with this opposite surface to obtain a temperature rise thereby lowering the temperature of the centerbody. This backside cooling of the centerbody can allow the temperature of the recirculation gases to exceed the material limit of the centerbody. Backside cooling allows for an increased temperature rise to be imparted to the fuel/air mixture; as the temperature of the recirculation gases contacting the centerbody are increased the temperature rise imparted to the fuel/air mixture is increased for any given flow.

The centerbody comprises a cap, a baffle, and a fuel/air channel. The cap is placed over the fuel/air channel exit such that the fuel/air mixture enters the space between the cap and the fuel/air channel, forcing the fuel/air mixture to be turned by, and to interact with, the cap. The exit of the fuel/air channel is above a majority of the exits for the cap. The term "above" refers to a direction parallel to (and in the same direction as) the flow of the fuel/air mixture in the fuel/air channel. The structure of the present invention, which should not be considered limiting, is to secure the base of the cap directly to the baffle with the fuel/air channel penetrating the baffle. The baffle forces all the fuel/air entering the cap to enter through the fuel/air channel. The cap can be of numerous three dimensional configurations, such as cylindrical or elliptical; symmetry is not required.

The cap should have a high thermal conductivity. Preferably, the thermal conductivity of the cap should allow for a distribution of the heat imparted to the cap from the recirculating gases.

For the present invention two fuel/air mixture flows are required—a fuel/air mixture flow through the flow conditioner and a fuel/air mixture flow through the centerbody. The fuel/air mixture can either be a single flow split between the flow conditioner and the centerbody based on the flow characteristics of both, or separate fuel/air flows with different characteristics. If separate fuel/air flows are provided, flow conditions could vary significantly, such as different fuel/air mixture ratios (even to the degree that one is rich and the other lean), different flow velocities, or different fuels. It is also possible to split a single fuel/air mixture but provide additional fuel injection to one or both of the two resulting fuel/air streams, thereby varying flow conditions, fuel/air mixture ratios, or fuel composition. These design alternatives can be done by those skilled in the art.

The catalyst is deposited on a selected portion or all of the surfaces of the cap of the centerbody. By controlling the placement of the centerbody in the flow conditioner, it is possible to control the residence time and mass transfer to the catalyst surface. By also controlling the catalyst activity (catalyst reactivity and surface coverage), the degree of catalytic pre-reaction imparted to the fuel/air mixture that exits the centerbody can be varied.

In addition, as the centerbody is placed within the pilot in such a way as to have the cap of the centerbody heated by the reaction gases, it is possible to use the catalyst deposited in this region to stabilize combustion within the pilot and heat the centerbody.

Since catalysts are employed for two distinct functions, several catalysts of different compositions could be used in the catalytic variant of the present invention. For example, the catalyst deposited on the surfaces of the cap being heated directly by the recirculating gases could be designed to directly support the combustion within the pilot and provide an exothermic reaction to heat the centerbody. A different catalyst might be used to provide catalytic pre-reaction of the fuel/air mixture traveling through the centerbody.

While the present invention contemplates that catalyst can be applied to selected surfaces of the centerbody, the backside (opposite side) of the surfaces exposed to the recirculating gases must not be coated with an active catalyst, so that the exposed surfaces of the centerbody cap are always backside cooled by the fuel/air mixture entering the centerbody.

DETAILED DESCRIPTION OF THE PREFERRED EMBODIMENTS

Figure 1:
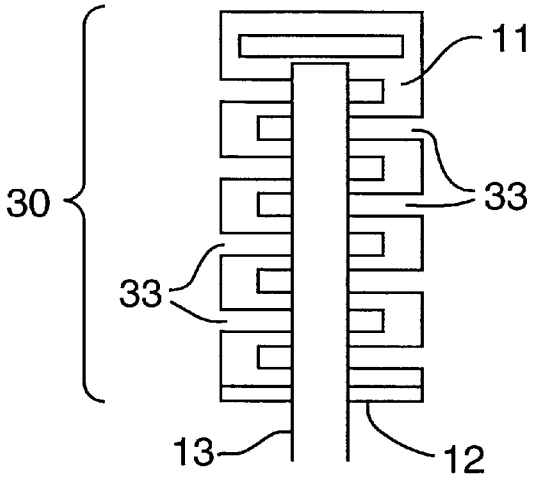
FIG. 1 is a cross-section of a centerbody.

FIG. 1 depicts a centerbody 30 which is comprised of a cap 11, a fuel/air channel 13 and a baffle 12. The cap 11 is placed adjacent to fuel/air channel 13 such that a path is created for the fuel/air mixture that enters the centerbody 30 through fuel/air channel 13. As shown in FIG. 1, cap 11 is a hollowed cylinder closed at one end, an entrance in the other end, and multiple exits 33 through the side. It is a requirement of the present invention that at least one exit 33 be located between the exit of fuel/air channel 13 and the closed end of cap 11. The sides of cap 11 extend to a point below the exit of fuel/air channel 13. The term "below" refers to a direction opposite the flow direction of the fuel/air mixture in the fuel/air channel 13.

FIG. 1 illustrates a concentric relationship between the fuel/air channel 13 and cap 11. The shape of the cap 11 is based upon the design requirements of the centerbody, and FIG. 1 should be considered illustrative rather than limiting.

Figure 2:
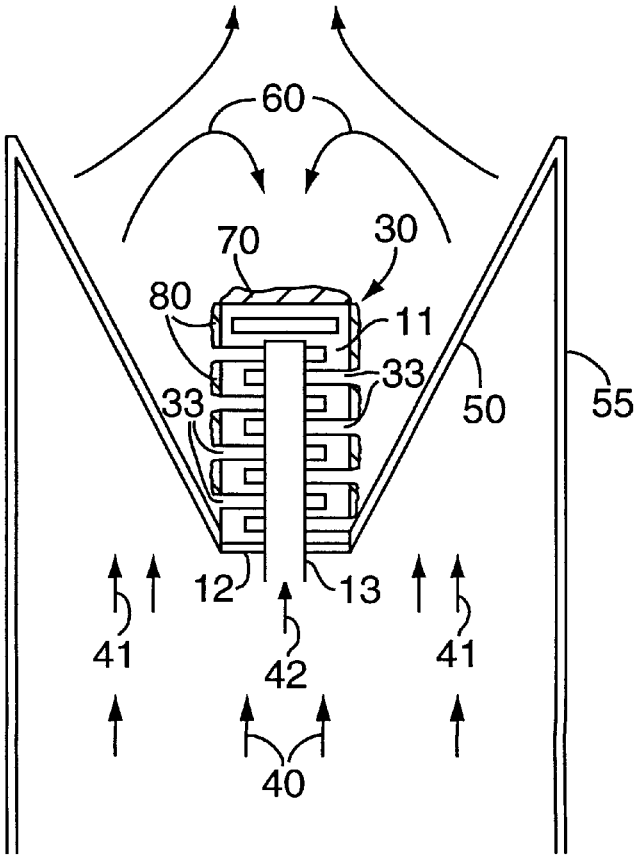
FIG. 2 is a cross-section of a pilot using a centerbody and a swirler as a flow conditioner.

FIG. 2 is a pilot employing a pilot wall 55, a centerbody 30, and a swirler 50, as the flow conditioner structure. Swirler 50 is mounted approximately concentrically within the pilot wall 55, and a centerbody 30 is mounted approximately concentrically within swirler 50. The pilot wall 55 confines a single fuel/air mixture 40 which is forced by pressure into the swirler 50 and the centerbody 30, forming fuel/air mixtures 42 and 41 respectively.

Swirler 50 is selected such that the swirl of swirler 50 will cause a recirculation zone to form sufficient to cause the recirculating combustion gases to contact the end of cap 11, throughout a significant portion of the operating range of the pilot.

To create a proper recirculation zone, swirler 50 must cause vortex breakdown within the swirl zone sufficient to cause flow reversal and backmixing. Generally, a swirl number greater than 0.5 is required to achieve this result. For this invention, the swirl number is defined as the quotient which results when tangential momentum flux is divided by the product of swirler radius and axial momentum flux. Tangential momentum flux is defined as the product of density, axial velocity, tangential velocity, radius, and flow area. Axial momentum flux is defined as the product of the density, the square of axial velocity, and the flow area. The combination of a dump (sudden expansion in flow area) and swirl is particularly effective in creating a strong recirculation zone, especially at low swirl number (order of magnitude 0.5). In a preferred embodiment of the present invention, a dump is located downstream of the swirler to assist in stabilizing combustion and providing strong recirculation of hot combustion gases to contact the pilot centerbody.

As the fuel/air mixture 40 enters the pilot the fuel/air mixture flow is split naturally between the centerbody 30 and the swirler 50. The minimum fuel/air flow entering the fuel/air channel 13 is based upon the fuel/air mixture flow required to stabilize the combustion zone and provide cooling of the cap 11, in the area where the cap is being heated by the recirculating gases 60. Those skilled in the art will appreciate that the backside cooling provided by the fuel/air mixture flow exiting fuel/air channel 13 maintains the temperature of cap 11 at an appropriate operating temperature, based upon the materials used to construct cap 11. The fuel/air mixture 42 flow should be no less than approximately 1% of the total fuel/air mixture 40 flow and should not exceed approximately 25%. A preferred range is between 3% and 10%.

The required degree of interaction between the fuel/air mixture exiting the fuel/air channel and the backside surface of the cap is determined by the desired temperature rise in fuel/air mixture 42; a temperature rise of the fuel/air mixture 42 is preferably at least 25 degrees Celsius. Allowable residence time is limited by either the auto-ignition delay time of the fuel/air mixture 42, or the requirement for maintaining sufficient velocity within the passage to prevent flashback of the flame. A nominal residence time is approximately 1 msec, but it could range from 0.1 to 10 msec.

As illustrated in FIG. 2, the cap 11 can be coated with catalyst. In the preferred embodiment the recirculation gases 60 only impinge on the top of the cap, therefore if more than one catalyst is used the top of the cap is one region and the sides of the cap are a second region. The boundary of these regions will change to coincide with the boundary created by the recirculation gases 60.

In general, the extent of the catalyst coating applied is a function of the conversion desired, and is based on such factors as residence time and catalyst composition. FIG. 2 illustrates the application of first catalyst 70 onto cap 11 on the outside surface of cap 11, directly exposed to the recirculation products 60. FIG. 2 further illustrates using a second catalyst 80 applied to the cap on the outside surface of cap 11 away from the area being heated by the recirculating flow 60. The applications of first catalyst 70 and second catalyst 80 are such that both catalysts are backside cooled by the fuel/air mixture exiting the fuel/air channel. While not shown, a catalyst could be added to the inside of the cap. In the event of a catalyst application in this area, it is critical that the backside cooling by fuel/air mixture 42 be retained. For this case, the rate of mass transfer to the catalyst surface should exceed the rate of chemical reaction on the surface, to maintain a kinetically controlled reaction at catalyst surface temperatures below the adiabatic flame temperature of the fuel/air mixture. For the present invention where methane is the fuel, the first and second catalyst would employ at least one Group VIII element as the core catalyst.

First catalyst 70 can be the same composition as second catalyst 80 or different depending upon the specific design requirements. The requirements for a first catalyst 70 are based on the dual requirements of supporting stabilization of the combustion within the pilot and the need for heating cap 11 above the temperature it would reach due to heat transfer from the recirculating gases 60. In the present embodiment of the invention first catalyst 70 is of the same composition as second catalyst 80.

The first and second catalyst, 70 and 80 respectively, are formulated to meet the requirements of the pilot. Catalysts containing palladium or platinum are preferred when the fuel/air mixture 42 is a hydrocarbon. The primary difference to be accounted for in the formulations of the two catalysts is that the first catalyst 70 must be capable of withstanding a higher temperature, in the preferred embodiment up to approximately 1000 degrees C., due to the exposure of the first catalyst 70 to the recirculating gases. When a first catalyst 70 is used, cap 11 should reach a temperature of approximately 50 to 500 degrees Celsius above the temperature of the fuel/air mixture 42.

The materials used for the pilot must be suitable for the temperatures that will be encountered. In the preferred embodiment HASTALLOY Alloy X (UNS N06002) was used, but the precise material selection is based on the application.

What is claimed is:

1. A centerbody comprising:

a fuel tube with an entrance and an exit, a cap with a side, a first end and an entrance, a closed second end opposite said first end, said side defining an interior area, said cap having at least one exit through said side, said fuel tube extending at least part way into said cap interior area, a baffle, said baffle blocking said cap entrance, thereby forcing a fuel/air mixture into said fuel tube entrance, said fuel tube penetrating said baffle into said interior area, the exit of said fuel tube positioned in said interior area such that said at least one cap exit is between said fuel tube exit and said first end, a first catalyst deposited on the outside surface of said cap, and wherein a fuel/air mixture exiting said fuel tube impinges upon said closed end of said cap.

2. The centerbody of claim 1 wherein said first catalyst is deposited on the outside of said cap on said first end.

3. The centerbody of claim 2 further comprising a second catalyst deposited on an outside surface of said side of said cap.

4. The centerbody of claim 3 wherein said first catalyst comprises a Group VIII element and said second catalyst comprises a Group VIII element.

5. The centerbody of claim 1 wherein said first catalyst comprises a Group VIII element.

6. A pilot, said pilot comprising:

a pilot wall, said wall forming a first interior area, a flow conditioner, a centerbody, said centerbody comprising a fuel tube with an entrance and an exit, a cap with a side, a first end and an entrance, said cap having at least two exits through said side, a baffle, said baffle connecting said cap to said fuel tube, said fuel tube positioned in said cap such that at least one of said cap exits is between said fuel tube exit and said first end, and a first catalyst deposited on said cap, said centerbody mounted in said flow conditioner, said flow conditioner attached to said pilot wall.

7. The pilot of claim 6 wherein said first catalyst is deposited on an outside surface defined by said cap at said first end.

8. The pilot of claim 7 further comprising a second catalyst deposited on the outside of said cap on said side.

9. The pilot of claim 7 wherein said first catalyst comprises a Group VIII element and said second catalyst comprises a Group VIII element.

10. The pilot of claim 6 wherein said first catalyst comprises a Group VIII element.

11. The pilot of claim 6 wherein said flow conditioner is a swirler.

12. The pilot of claim 11 wherein said first catalyst is deposited on an outside surface defined by said cap at said first end.

13. The pilot of claim 12 further comprising a second catalyst deposited on the outside of said cap on said side.

14. The pilot of claim 13 wherein said first catalyst comprises a Group VIII element and said second catalyst comprises a Group VIII element.

15. The pilot of claim 12 wherein said first catalyst comprises a Group VIII element.

16. A method for enhancing a first fuel/air mixture so that when said first fuel/air mixture is added to a second fuel/air mixture said second fuel/air mixture will combust with greater stability, said method comprising the steps of:

generating said first fuel/air mixture, passing said first fuel/air mixture through a centerbody, said centerbody comprising, a fuel tube with an entrance and an exit, a cap with a side, a first end and an entrance, said cap having at least two exits through said side, a baffle, said baffle connecting said cap to said fuel tube, said fuel tube positioned in said cap such that at least one of said cap exits is between said fuel tube exit and said first end, and a first catalyst deposited on said cap and heating said centerbody using heat of combustion generated by said second fuel/air mixture.

17. The method of claim 16 wherein said first catalyst is deposited on an outside surface defined by said cap at said first end.

18. The method of claim 17 further comprising a second catalyst deposited on the outside of said cap on said side.

19. The method of claim 18 wherein said first catalyst comprises a Group VIII element and said second catalyst comprises a Group VIII element.

20. The method of claim 17 wherein said first catalyst comprises a Group VIII element.

21. The method of claim 16 wherein said first catalyst comprises a Group VIII element.

* * * * *